United States Patent [19]

Thompson

[11] 3,952,675

[45] Apr. 27, 1976

[54] SEWING MACHINE FEED CONVERSION APPARATUS

[76] Inventor: Elmer R. Thompson, 4712 Avenue Q, Lubbock, Tex. 79412

[22] Filed: Mar. 26, 1975

[21] Appl. No.: 562,209

[52] U.S. Cl. ..... 112/212

[51] Int. Cl.[2] ..... D05B 27/04

[58] Field of Search ..... 112/212, 203, 207

[56] References Cited

UNITED STATES PATENTS

| | | | |
|---|---|---|---|
| 2,470,759 | 5/1949 | Clayton | 112/212 |
| 3,570,427 | 3/1971 | Wenz et al. | 112/212 |
| 3,605,662 | 9/1971 | Willenbacher et al. | 112/212 |
| 3,757,714 | 9/1973 | Gustmann et al. | 112/212 |

*Primary Examiner*—George H. Krizmanich
*Attorney, Agent, or Firm*—C. Clark Dougherty, Jr.

[57] ABSTRACT

The present invention is directed to apparatus for attachment to a conventional sewing machine to convert the sewing machine to one having a top and bottom workpiece feed mechanism whereby workpieces of extra thickness can be fed through the mechanism and stitched by the machine. The apparatus of the present invention includes a frame adapted to be attached to a side of the sewing machine, a vertically positioned tubular member pivotally attached to the forward end of the frame so that the member is free to move horizontally but not vertically, a feed foot bar telescopically mounted within the tubular member so that the feed foot bar is free to move vertically and is moved horizontally with the movement of the tubular member, and a feed foot attached to the feed foot bar positioned above the sewing machine work supporting surface adjacent the sewing machine feed dog disposed therein. A feed rod adapted to be operably connected to the feed shaft of the sewing machine which imparts forward and rearward motion to the feed dog is connected by a train of mechanism attached to the frame to the tubular member so that when the sewing machine feed dog is moved in the direction of feed and returned the tubular member is moved in a like manner. A lift rod adapted to be operably connected to the lifting shaft of the sewing machine which imparts the upward and downward motion to the feed dog is connected by a train of mechanism attached to the frame to the feed foot bar so that when the feed dog is raised and lowered, the feed foot bar and feed foot attached thereto are simultaneously lowered and raised.

4 Claims, 12 Drawing Figures

SEWING MACHINE FEED CONVERSION APPARATUS

BACKGROUND OF THE INVENTION

1. Field of the Invention

The present invention relates generally to sewing machine feed conversion apparatus, and more particularly, and not by way of limitation, to an apparatus for attachment to a sewing machine having a bottom workpiece feed mechanism to convert said machine to one having a top and bottom workpiece feed mechanism whereby workpieces of extra thickness can be fed through said machine.

2. Description of the Prior Art

Many various sewing machine apparatus both for domestic use and commercial use have been developed. Generally, sewing machines intended for domestic use include bottom workpiece feed mechanisms. That is, a feed dog is provided positioned in the work supporting surface of the machine which is raised, moved in the direction of feed, lowered, and moved in the opposite direction with each cycle of the needle bar. Such machines also include a presser foot for urging the workpiece being stitched against the work supporting surface so that the feed dog contacts the workpiece and moves it forward when the feed dog is raised and moved in the direction of feed.

Sewing machines intended for commercial use, on the other hand, generally include feed mechanisms which grip the top and bottom surfaces of the workpiece whereby the workpiece can be of extra thickness but still fed through the mechanism and stitched by the machine. Such top and bottom workpiece gripping feed mechanisms usually include a feed dot of the type described above positioned below the workpiece and a feed foot positioned above the workpiece which moves in timed relationship with the feed dog to advance the workpiece. That is, the feed foot is lowered into contact with the top surface of the workpiece at the same time the feed dog is raised into contact with the bottom surface thereof and both are moved in the direction of feed simultaneously so that the workpiece is advanced. Such simultaneous top and bottom workpiece gripping feed mechanisms make it possible for extra thick workpieces or multi-layered workpieces to be advanced and stitched by the machine.

Commercial sewing machines are generally considerably more expensive than domestic sewing machines which include only a bottom feed dog and a presser foot. By the present invention, apparatus is provided which can be attached to a domestic sewing machine to convert the machine to one having a top and bottom workpiece gripping feed mechanism thereby allowing the sewing machine to feed and stitch workpieces of extra thickness at a cost substantially less than that required for the purchase of a commercial sewing machine.

SUMMARY OF THE INVENTION

The present invention is directed to an apparatus for attachment to a sewing machine having a bottom workpiece feed mechanism comprised of a feed dog positioned in the work supporting surface of said machine which is raised and lowered by the oscillating motion of a lifting shaft and moved in the direction of feed and returned in the opposite direction by the oscillating motion of a feed shaft, a vertically oscillated needle bar, and a presser foot attached to a presser bar for urging the workpiece being stitched against said work supporting surface and said feed dog, the apparatus converting the sewing machine to one having a simultaneous top and bottom workpiece gripping feed mechanism whereby workpieces of extra thickness can be fed through the mechanism and stitched by the machine. The apparatus includes a frame adapted to be attached to a side of the sewing machine, a vertically positioned tubular member pivotally attached to the forward end of the frame so that the tubular member is free to move horizontally but not vertically, a feed foot bar telescopically mounted within the lower end of the tubular member so that the feed foot bar is free to move vertically and is moved horizontally with the horizontal movement of the tubular member and a feed foot attached to the feed foot bar positioned above the sewing machine work supporting surface adjacent the feed dog. Bell crank means for converting vertical oscillating motion to horizontal oscillating motion are pivotally attached to the frame and to the tubular member for imparting horizontal motion thereto. Feed rod means adapted to be operably connected to the feed shaft of the sewing machine are provided so that vertical oscillating motion corresponding to the oscillating motion of the feed shaft is imparted to the feed rod means. Means for transmitting the vertical oscillating motion of the feed rod means to the bell crank means are attached to the frame and connected between the feed rod means and bell crank means so that when the feed dog is moved in the direction of feed and returned by the oscillating motion of the feed shaft, the tubular member attached to the frame is moved horizontally in a like manner. Link means are attached to the feed foot bar for imparting vertical oscillating motion thereto and lift rod means adapted to be operably connected to the lifting shaft of the sewing machine are provided so that reverse direction vertical oscillating motion corresponding with the oscillating motion of the lifting shaft is imparted to the lift rod means. Means for transmitting the vertical oscillating motion of the lift rod means to the link means are attached to the frame and connected between the lift rod means and link means so that when the feed dog is raised and lowered by the oscillating motion of the lifting shaft, the feed foot bar and feed foot attached thereto are simultaneously lowered and raised.

It is, therefore, a general object of the present invention to provide a sewing machine feed conversion apparatus.

A further object of the present invention is the provision of apparatus for attachment to a domestic sewing machine having a bottom workpiece feed machanism to convert the sewing machine to one having a simultaneous top and bottom gripping workpiece feed mechanism whereby workpieces of extra thickness can be fed through the mechanism and stitched by the machine.

Yet a further object of the present invention is the provision of apparatus adapted for attachment to a domestic sewing machine whereby the sewing machine is converted to one having the capability of sewing workpieces of extra thickness at a cost considerably less than a commercial sewing machine having the same capability.

Other and further objects, features and advantages of the invention will be readily apparent to those skilled in the art upon a reading of the description of preferred embodiments which follows when taken in conjunction with the accompanying drawings.

DESCRIPTION OF PREFERRED EMBODIMENTS

Figure 1:
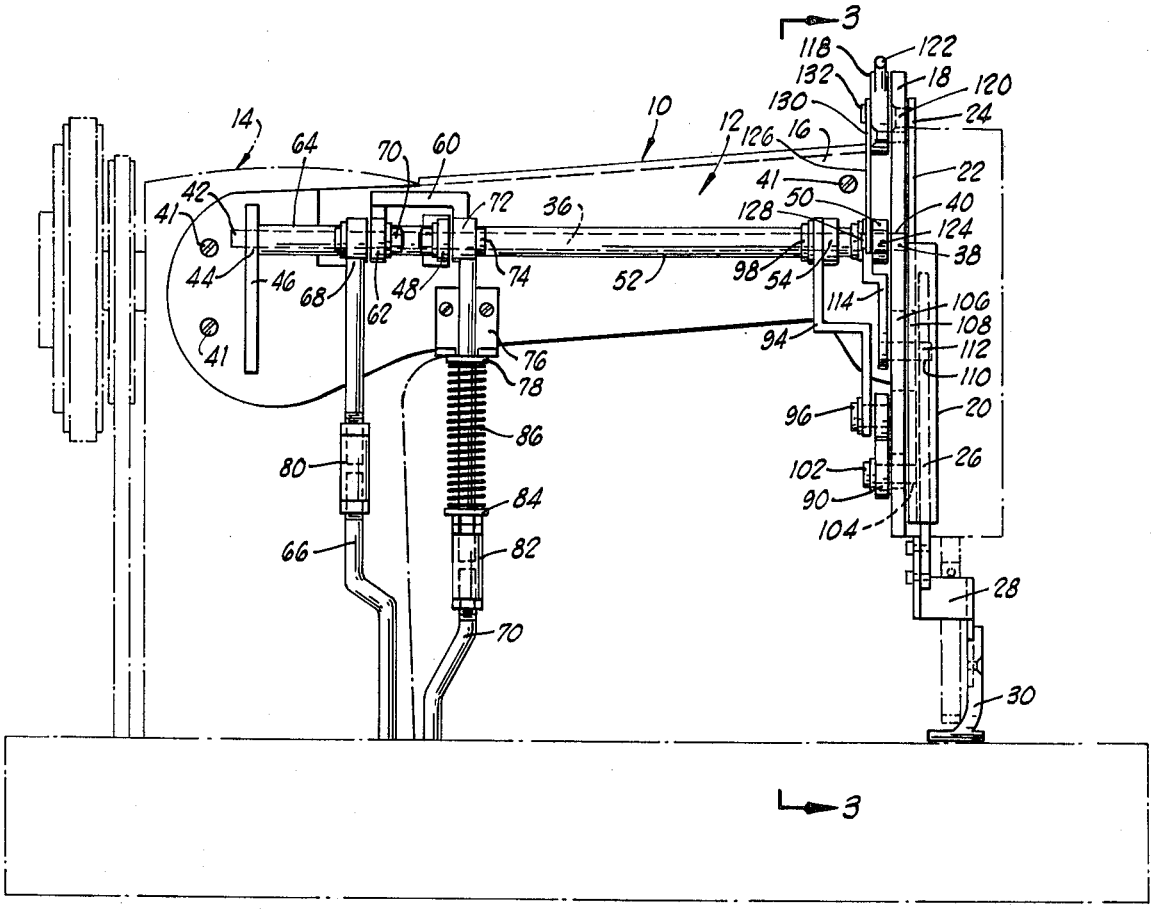
FIG. 1 is a side elevational view of apparatus of the present invention.

Sewing machines designed for domestic use generally include a bottom workpiece feed mechanism comprised of a feed dog positioned in the work supporting surface of the sewing machine which is raised and lowered by the oscillating motion of a lifting shaft and moved in the direction of feed and returned in the opposite direction by the oscillation motion of a feed shaft. The lifting and feed shafts are imparted their oscillation motions by trains of conventional mechanism interconnected to a rotating power shaft which is provided its rotation motion by the sewing machine electric motor or foot pedal. A pressure foot attached to a spring loaded presser bar is provided on such sewing machines for urging the workpiece being stitched against the work supporting surface and the feed dog positioned therein. The movements of the sewing machine needle bar and the feed dog are timed by the sewing machine mechanism so that as the needle bar is raised to its upper position, the feed dog is raised and moved in the direction of feed so that the workpiece is advanced, and as the needle bar is lowered to force the needle through the workpiece, the feed dog is lowered and returned in a direction opposite the direction of feed. Thus, the feed dog is raised, moved in the direction of feed, lowered and returned to its original position during each up and down cycle of the needle bar.

The apparatus of the present invention is adapted to be attached to a domestic sewing machine and convert the bottom workpiece feed mechanism thereof to a top and bottom workpiece gripping feed mechanism whereby workpieces of extra thickness can be fed through the mechanism and stitched by the machine.

Referring now to the drawings, and particularly to FIGS. 1 through 5, attachment apparatus of the present invention is illustrated and generally designated by the numeral 10. The apparatus 10 basically comprises a frame 12 adapted to be attached to a side of a domestic sewing machine 14. The forward end 16 of the frame 12 includes a flat plate 18 positioned vertically and in a plane substantially perpendicular to the axis of the sewing machine 14.

A tubular member 20, preferably in the form of a rectangular channel is positioned vertically and pivotally attached to the flat plate 18 in a manner such that the tubular member 20 is free to move in substantially horizontal directions, but not vertically. In a preferred arrangement, one end of an arcuate member 22 is attached to the top of the vertically positioned tubular member 20 with the other end pivotally attached to the flat plate 18 by means of a conventional pin 24. In this arrangement, the pivot point of the tubular member 20 and arcuate member 22 is offset from the axis of the tubular member 20 and positioned vertically above the feed dog of the sewing machine 14.

A feed foot bar 26, preferably rectangular in shape, is telescopically mounted within the tubular member 20 so that the feed foot bar 26 is free to move vertically within the tubular member 20 and is moved horizontally with the movement of the tubular member 20. A feed foot bracket 28 is rigidly attached to the lower end of the feed foot bar 26 and a feed foot 30 is attached to the bracket 28. The bracket 28 is formed of a shape such that the feed foot 30 attached thereto is positioned above and adjacent the feed dog of the sewing machine 14. The feed foot 30 includes a plurality of serrations or teeth 34 on the lower surface thereof for gripping the top surface of the workpiece being stitched by the sewing machine 14.

Referring still to FIGS. 1 through 5, a horizontally positioned elongated rod 36 is pivotally attached to the frame 12. That is, the forward end 38 of the rod 36 is journaled in a bore 40 provided in the flat plate 18, and the rearward end 42 of the rod 36 is journaled in a bore 44 provided in a bracket 46 welded or otherwise attached to the rearward end of the frame 12. An outwardly extending arm member 48 is rigidly attached to the rod 46, such as by welding, at a point between the forward and rearward ends 38 and 42 thereof. A second outwardly extending arm member 50 is rigidly attached to the rod 36 adjacent the forard end 38 thereof. An elongated tube 52 is pivotally disposed over the rod 36 between the arm members 48 and 50 attached thereto. An outwardly extending arm member 54 is rigidly attached to the tube 52 adjacent the forward end 56 thereof, and the rearward end 58 of the tube 52 is rigidly attached to a bracket 60 which is in turn attached to an outwardly extending arm member 62. A sleeve or spacer 64 is disposed over the rearward end portion of the rod 36 between the arm member 62 and the bracket 46. Thus, vertical oscillating motion imparted to the arm member 48 attached to the rod 36 is transmitted by the rod 36 to the arm member 50 also attached thereto. In a similar fashion, vertical oscillating motion imparted to the arm member 62 which is attached to the tube 52 by the bracket 60 is transmitted by the tube 52 to the arm member 54 attached thereto.

Figure 2:
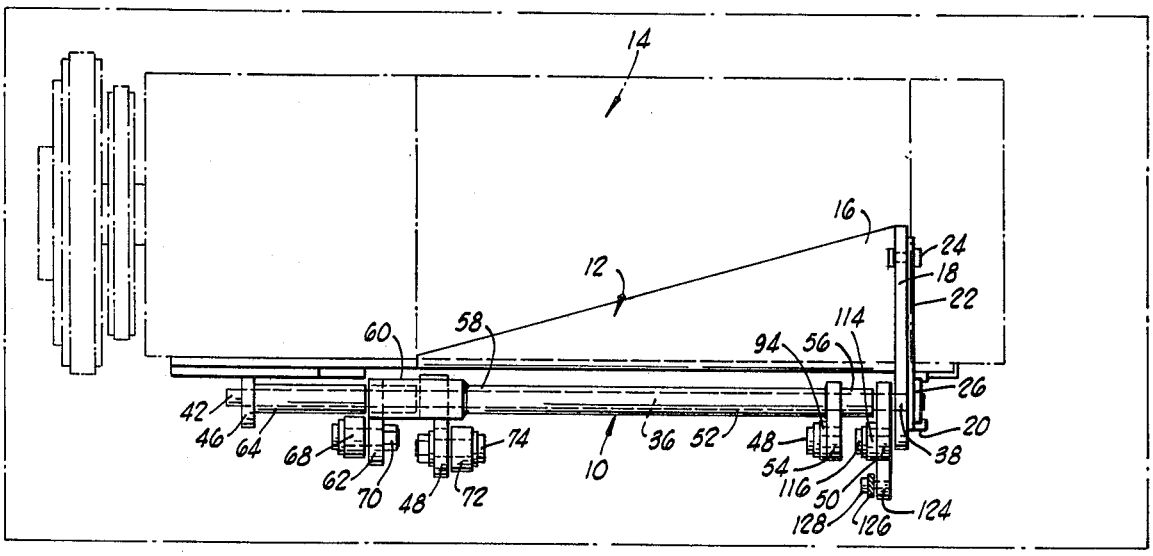
FIG. 2 is a top plan view of a portion of the apparatus illustrated in FIG. 1.

As shown in FIGS. 1 and 2, a vertically positioned feed rod 66 is pivotally connected at its upper end 68 to the arm member 62 by emans of a pin or bolt 70. As will be described further hereinbelow, the lower end of the feed rod 66 is operably connected to the feed shaft mechanism of the sewing machine 14 so that vertical oscillating motion corresponding to the motion of the feed shaft is transferred to the arm member 62 by way of the feed rod 66.

A vertically positioned lift rod 70 is provided, the upper end 72 of which is pivotally connected to the arm member 48 by a pin or bolt 74. The lower end of the lift rod 70 is operably connected to the lifting shaft mechanism of the sewing machine 14 in a manner to be described hereinbelow so that vertical oscillating motion corresponding to the motion of the lifting shaft but reversed in direction therefrom is transmitted to the arm member 48 by the lift rod 70.

A bracket 76 is attached to the frame 12 adjacent the top portion of the lift rod 70 which includes an outwardly extending portion disposed around the lift rod 70. A disk or washer 78 is slidably disposed over the lift rod 70 and positioned adjacent the bracket 76. Conventional connectors 80 and 82 are disposed in the feed rod 66 and lift rod 70, respectively, for adjusting the length thereof, and the upper end of the connector 82 is utilized to support a second disk or washer 84 slidably disposed over the lift rod 70. A spring 86 is disposed around the lift rod 70 between the washers 78 and 84 so that the spring 86 constantly urges the lift rod 70 and the arm member 48 pivotally connected thereto downwardly.

Figure 3:
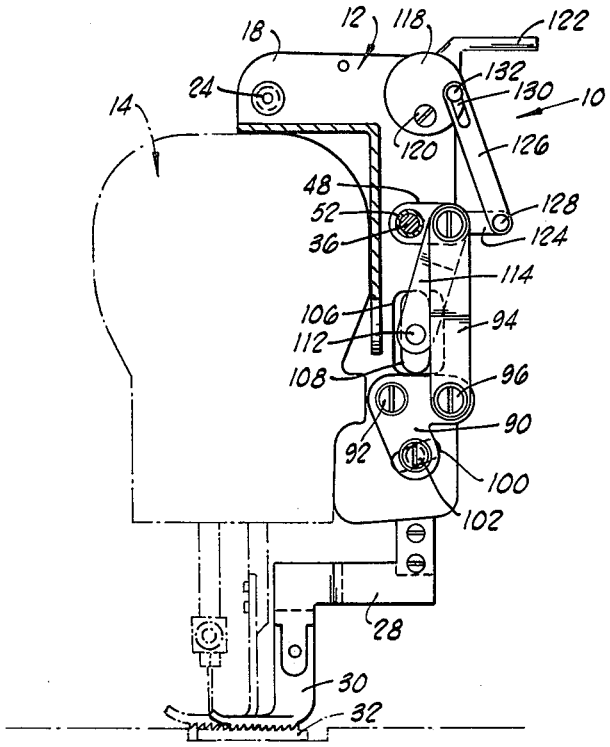
FIG. 3 is a sectional view taken along line 3—3 of FIG. 1.

As best shown in FIGS. 1 and 3, a bell crank 90 is provided, the fulcrum of which is pivotally attached to the flat plate 18 of the frame 12 by means of a pin or bolt 92. One of the arms of the bell crank 90 is pivotally connected to the lower end of a link 94 by means of a pin or bolt 96. The upper end of the link 94 is pivotally connected to the arm member 54, previously described, by means of a pin or bolt 98. Thus, the oscillating motion of the tube 52 is transmitted by means of the arm member 54 and the link 94 to the bell crank 96. A slot 100 is provided in the flat plate 18 of the frame 12 and a pin 102 rigidly attached to the other arm of the bell crank 90 extends through the slot 100 into engagement with the tubular member 20. That is, a bore 104 is provided in the surface of the tubular member 20 adjacent the flat plate 18 into which the end of the pin 102 extends thereby providing a pivotal connection between the bell carnk 90 and the tubular member 20. Vertical oscillating movement transmitted to the bell crank 90 by the link 94 is converted to horizontal oscillating movement by the bell crank 90 which is transmitted to the tubular member 20 by the pin 102 connected thereto and pivotally connected to the tubular member 20.

As best shown in FIG. 3, a second slot or opening 106 is provided in the flat plate 18 of the frame 12, and a slot 108 is provided in the surface of the tubular member 20 adjacent the slot 106 in the flat plate 18. The feed foot bar 26 includes a bore 110 disposed therein and a pin 112, which is rigidly attached to the lower end of a link 114, extends through the slot 106 in the flat plate 18, through the slot 108 in the tubular member 20 and into the bore 110 of the feed foot bar 26. The upper end of the link 114 is pivotally connected to the arm member 50 attached to the rod 36, previously described, by means of a pin 116. Thus, the vertical oscillating motion of the arm member 50 is transmitted by way of the link 114 and the pin 112 to the feed foot bar 26.

Referring still to FIGS. 1 and 3, a feed foot lifter mechanism is provided for manually raising the feed foot 30 comprised of a disk 116 eccentrically and pivotally mounted on the flat plate 18 of the frame 12 by means of a bolt or pin 120. A handle 122 is attached to the disk 118 for manually rotating the disk 118. The arm member 50, previously described, includes an outwardly extending finger 124 attached thereto, and a link 126 is provided, the lower end of which is pivotally connected to the finger 124 by a pin 128. The upper end of the link 126 includes a slot 130 and a pin 132 extending through the slot 130 pivotally connects the upper end thereof to the disk 118. Thus, when the disk 118 is rotated by lifting the handle 122, the link 126 and finger 124 lift the arm member 50 which in turn lifts the feed foot bar 26 by means of the link 114 and pin 112.

Figure 6:
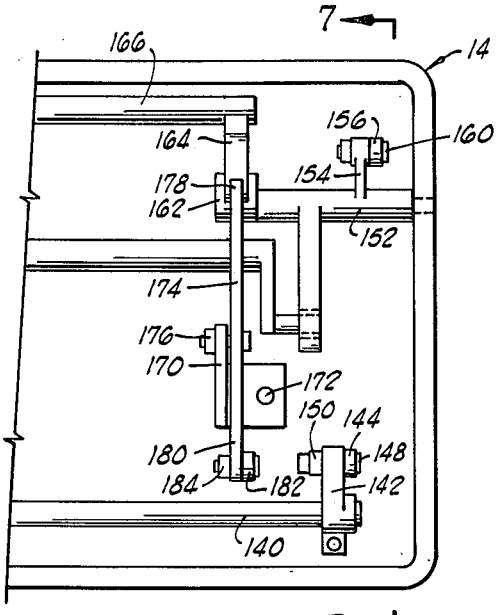
FIG. 6 is a bottom view of a portion of the sewing machine illustrated in FIGS. 4 and 5.
Figure 7:
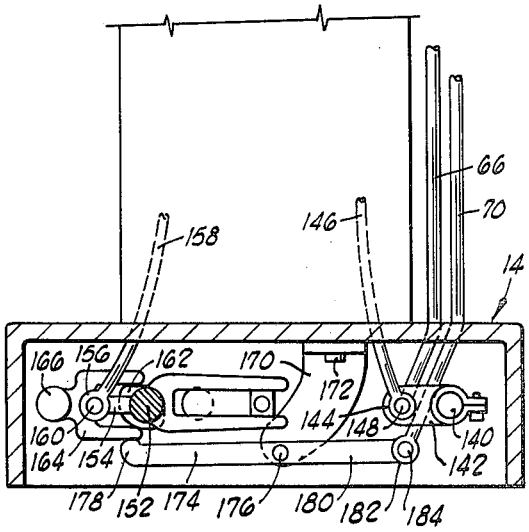
FIG. 7 is a cross sectional view taken along line 7—7 of FIG. 6.

Referring now specifically to FIGs. 6 and 7, portions of the sewing machine 14 are illustrated. That is, a portion of the conventional mechanism generally utilized in domestic sewing machines is illustrated with the feed rod 66 and lift rod 70 of the present invention connected thereto. While domestic sewing machines differ in design and construction they generally include mechanism of the type illustrated or the equivalent thereto.

A feed shaft 140 is provided having an arm member 142 rigidly connected thereto. The lower end 144 of a feed fork 146 is pivotally attached to the arm member 142 by a bolt 148. As wil be understood, the feed fork 146 is connected to the sewing machine power transfer apparatus whereby it is imparted vertical oscillating motion. The vertical oscillating motion of the feed fork 146 is transferred by way of the arm member 142 to the feed shaft 140 so that the feed shaft 140 is given an oscillating rotating motion. This motion of the feed shaft 140 is utilized by means of conventional mechanism to move the feed dog of the sewing machine in horizontal directions, i.e. in the direction of feed and in the opposite direction. The lower end 150 of the feed rod 66 of the apparatus of the present invention is also pivotally attached to the arm member 142 by the bolt 140 so that the vertical oscillating motion of the sewing machine feed fork 146 and the feed shaft 140 is transmitted to the feed rod 66. Thus, the vertical oscillating motion of the feed fork 146 which is utilized by way of the feed shaft 140 to move the feed dog 32 in horizontal directions is transmitted by way of the feed rod 66, the arm member 62 attached to the tube 52, the tube 52, the arm member 54, the link 94 and the bell crank 90 to the tubular member 20. As a result, as the feed dog 32 of the sewing machine is moved in the direction of feed or in the opposite direction, the tubular member 20, the feed foot bar 26 and the feed foot 30 of the apparatus of the present invention are moved in a like manner.

Referring still to FIGS. 6 and 7, an oscillating rock shaft 152 is pivotally mounted within the sewing machine 14. The rock shaft 152 includes an arm member 154 pivotally connected to the lower end 156 of a lift fork 158 by a bolt 160. Like the feed fork 146, the lift fork 158 is connected to the sewing machine power transfer mechanism which imparts vertical oscillating motion thereto. The vertical oscillating motion of the lift fork 146 is transferred by way of the arm 154 to the oscillating rock shaft 152. One end of the oscillating rock shaft 152 includes an eccentric cam 162. A fork type cam follower 164 which operably engages the eccentric cam 162 is provided rigidly connected to a lifting shaft 166. Thus, the oscillating motion of the oscillating rock shaft 152 is transferred by way of the eccentric cam 162 thereof and the fork cam follower 164 to the lifting shaft 166. As is understood by those skilled in the art, the oscillating motion of the lifting shaft 166 is utilized through conventional mechanism to raise and lower the feed dog 32 of the sewing machine 14.

In accordance with the present invention, a bracket 170 is provided attached to the bottom of the sewing machine 14 by a bolt 172. The bracket 170 pivotally supports the apex of a rocker arm 174 by means of a bolt 176. One end 178 of the rocker arm 174 rides on the lower surface of the fork cam follower 164 attached to the lifting shaft 166. The other end 180 of the rocker arm 174 is pivotally connected to the lower end 182 of the lift shaft 70 of the apparatus of the present invention by means of a pin 184. Thus, the rocker arm 174 functions to reverse the vertical oscillating motion of the fork cam follower 164 and lifting shaft 166 and transmits such reverse oscillating motion to the lift rod 70. The vertical oscillating motion of the lift rod 70 is transmitted by way of the arm member 48, the rod 36, the arm member 50, the link 114 and the pin 112 to the feed foot bar 26 and the feed foot 30. As a result, when the feed dog 32 of the sewing machine 14 is raised and lowered by the oscillating motion of the lifting shaft 166, the feed foot 30 of the apparatus of the present invention is lowered and raised, respectively, simultaneously therewith.

Figure 5:
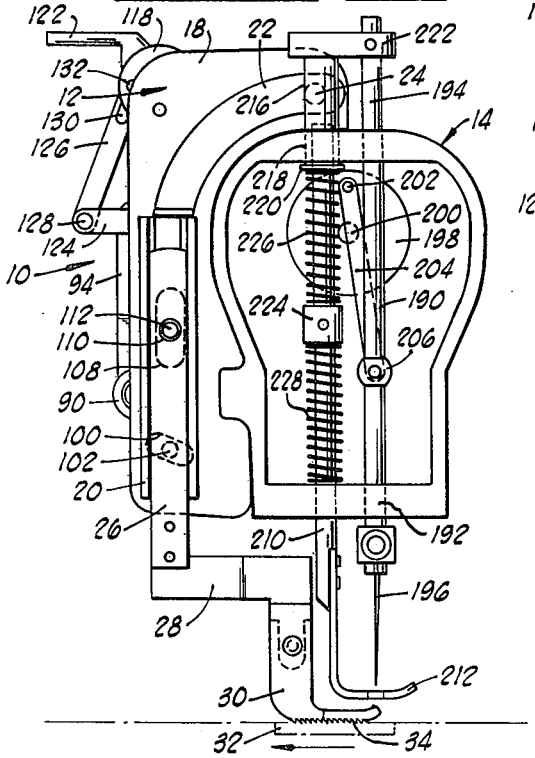
FIG. 5 is a front elevational view similar to FIG. 4 but showing the sewing machine in a different mode of operation.
Figure 4:
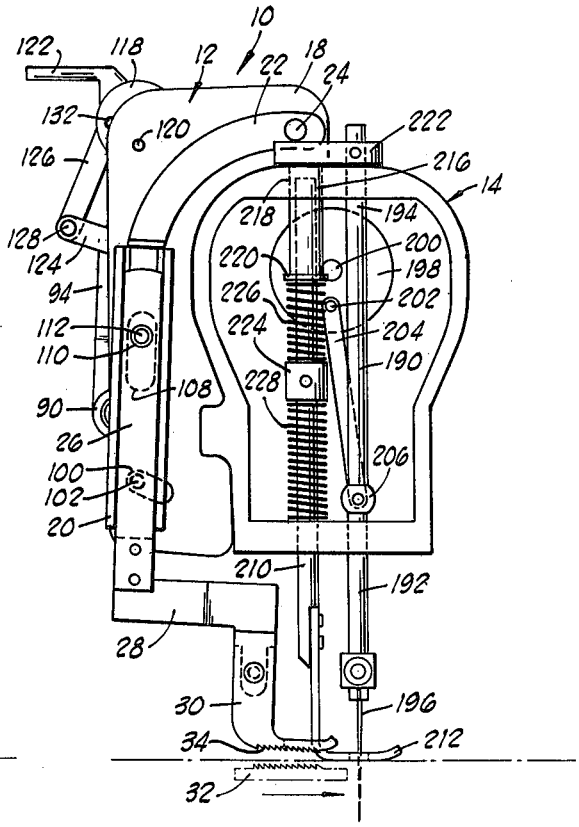
FIG. 4 is a front elevational view of a domestic sewing machine having the apparatus of the present invention attached thereto.

Referring now specifically to FIGS. 4 and 5, the sewing machine 14 is illustrated with the apparatus of the present invention attached thereto and with the cover plate removed from the forward end of the sewing machine so that the needle bar, presser bar and associated apparatus as well as apparatus of the present invention are illustrated. A vertically positioned needle bar 190 is disposed within the forward end of the sewing machine 14, the upper and lower ends 192 and 194 thereof, respectively, being slidably disposed through openings in top and bottom portions of the housing of the sewing machine. The bottom end 192 of the needle bar 190 which extends below the sewing machine housing has a needle 196 attached thereto in a conventional manner. A rotating cylinder or disk 198 for operating the needle bar 190 is disposed within the sewing machine 14 and functions to raise and lower the needle bar 190 in timed relation to the movement of the feed dog of the sewing machine. That is, the rotating disk 198 is connected by a shaft 200 to the sewing machine power transfer mechanism and includes an eccentrically positioned pin 202 extending outwardly from the forward surface thereof. A link 204 is pivotally connected to the pin 202, the bottom end of which is pivotally connected to the needle bar 190 by means of a conventional connecting member 206 attached thereto. Thus, as the disk 198 rotates, vertical oscillating motion is imparted to the needle bar 190 by the pin 202 and link 204. A presser bar 210 having a presser foot 212 connected thereto is slidably disposed through the lower portion fo the sewing machine housing and extends vertically upwardly within the housing. In accordance with one aspect of the present invention, apparatus is attached to the needle bar 190 and the presser bar 210 to cause the presser bat 210 and presser foot 212 attached thereto to be raised and lowered with the raising and lowering of the needle bar 190. More specifically, the apparatus of the present invention includes a tube member 216 slidably disposed in a bore 218 positioned in the top of the sewing machine housing so that the tube member 216 is free to slide vertically within the bore 218. The lower end of the tube member 216 extending within the sewing machine 14 is formed into an annular flange 220. The tube member 216 is telescopically positioned over the upper end of the presser bar 210 so that the upper end of the presser bar 210 is free to move vertically within the tube member 216, and the tube member 216 is free to move downwardly over the upper end of the presser bar 210. A bracket 222 is rigidly attached to the top end of the tube member 216 extending above the sewing machine housing and to the top end of the needle bar 190 which extends above the housing. Thus, the tube member 216 is reciprocated simultaneously with the reciprocation of the needle bar 190. A sleeve 224 is rigidly attached to the presser bar 210 at a point within the housing of the sewing machine to provide upwardly and downwardly facing annular surfaces thereon. A first spring 226 is disposed around the presser bar 210 between the annular flange 220 of the tube member 216 and the upwardly facing surface of the sleeve 224. A second spring 228 is disposed around the presser bar 210 between the downwardly facing surface of the sleeve 224 and an upwardly facing surface of the housing of the sewing machine. The first spring 226 is of greater resiliency than the second spring 228 so that as the needle bar 190 and the tube member 216 are moved downwardly, the spring 226 is compressed which in turn compresses the spring 228 and moves the presser bar 210 and presser foot 212 attached thereto downwardly. When the needle bar 190 and tube member 216 are moved upwardly, the spring 226 expands which allows the spring 228 to expand and thereby move the presser bar 210 and presser foot 212 upwardly. When in the downward position, the presser bar 210 and presser foot 212 are free to move upwardly and/or downwardly with variations in the thickness of the workpiece being stitched but are constantly urged downwardly by the spring 226.

Figure 8:
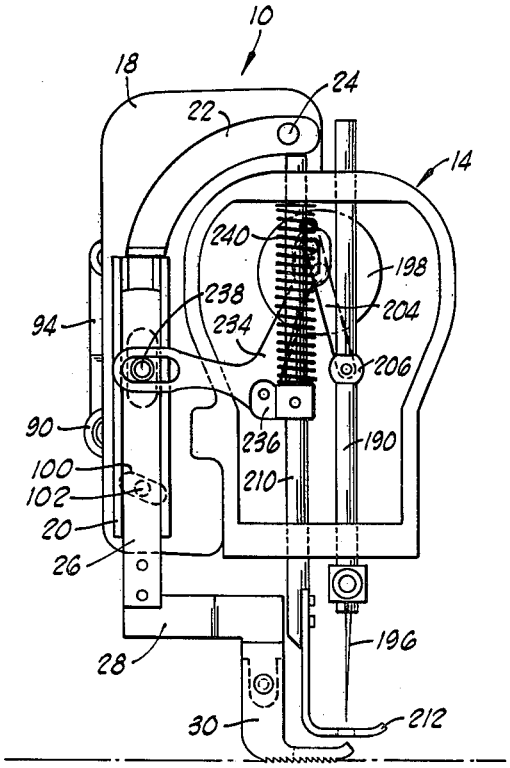
FIG. 8 is a front elevational view of a domestic sewing machine having an alternate arrangement of apparatus of the present invention attached thereto.
Figure 9:
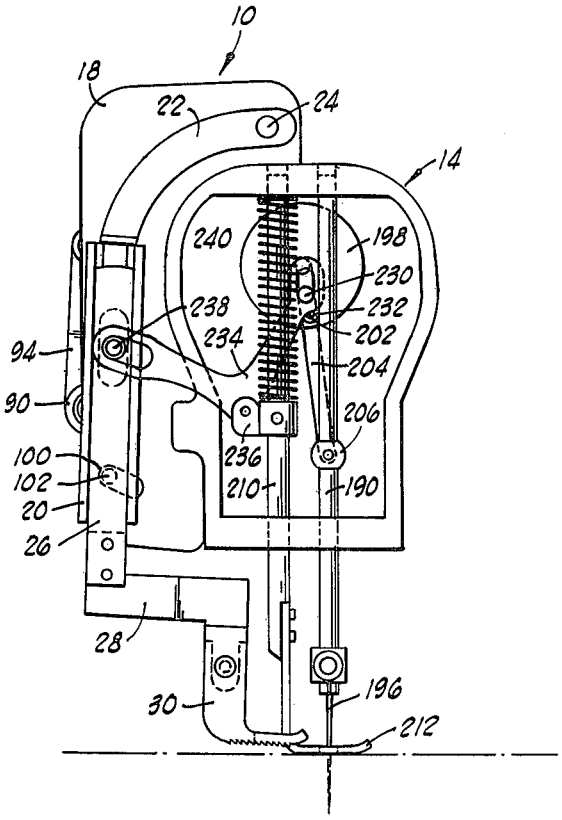
FIG. 9 is a front elevational view similar to FIG. 8 but showing the sewing machine in a different mode of operation.

Referring now to FIGS. 8 and 9, an alternate arrangement of apparatus of the present invention is illustrated. In this embodiment, the lift rod 70 and means associated therewith for transmitting the vertical oscillating motion of the lift rod 70 to the feed foot bar 26 are eliminated. That is, the lift rod 70, the arm member 48 attached to the rod 36, the arm member 50 attached to the rod 36, the link 114 and the pin 112 are eliminated. As will be understood, the tube 52 can also eliminated and the arm members 62 and 54 attached to the rod 36 instead of the tube 52. Thus, only the vertical oscillating motion of the feed rod 66 is transmitted by the mechanism attached to the frame 12 to the link 94 and bell crank 90 causing the tubular member 20, feed foot bar 26 and feed foot 30 to be moved in horizontal directions in time with the feed dog 32 of the sewing machine 14. The manual lifting mechanism comprised of the disk 18, link 126, arm 124, etc. are also eliminated in that they are not required for reasons to be described further hereinbelow.

In the embodiment of the invention illustrated in FIGS. 8 and 9, the vertical oscillating movement of the feed foot 30 as well as the vertical oscillating movement of the presser foot 212 are imparted thereto by an assembly operated by a cam attached to the rotating disk 198 of the sewing machine 14. More specifically, a pin type cam 230 is rigidly attached to the disk 198 so that the cam rotates in a circle. A presently preferred technique for attaching the cam 230 to the disk 198 is to weld an arm 232 to which the pin 230 is attached to the pin 202 to which the link 204 is pivotally connected. As the disk 198 is rotated, the link 204 pivots on the pin 202 and causes the needle bar 190 to be vertically oscillated as previously described. The arm 232 and pin 230 remain in a fixed position with respect to the disk 98 so that the pin 230 travels in a circular path. A cam follower member 234 having a bell crank configuration is operably connected to the cam 230 and pivotally connected to the presser bar 210 and feed foot bar 26. That is, the apex of the member 234 is pivotally attached by a connecting means 236 to the presser bar 210 at a point within the housing of the sewing machine. The end of one arm of the member 234 includes a slot type cam follower through which the cam 230 extends. The other arm of the member 234 is pivotally connected to a pin 238 which is rigidly attached to the feed foot bar 26. A spring 240 is disposed around the presser foot bar between the connecting means 236 and a downwardly facing surface of the housing of the sewing machine 14 so that a constant downward force is applied to the presser bar by the spring 240.

Figure 10:
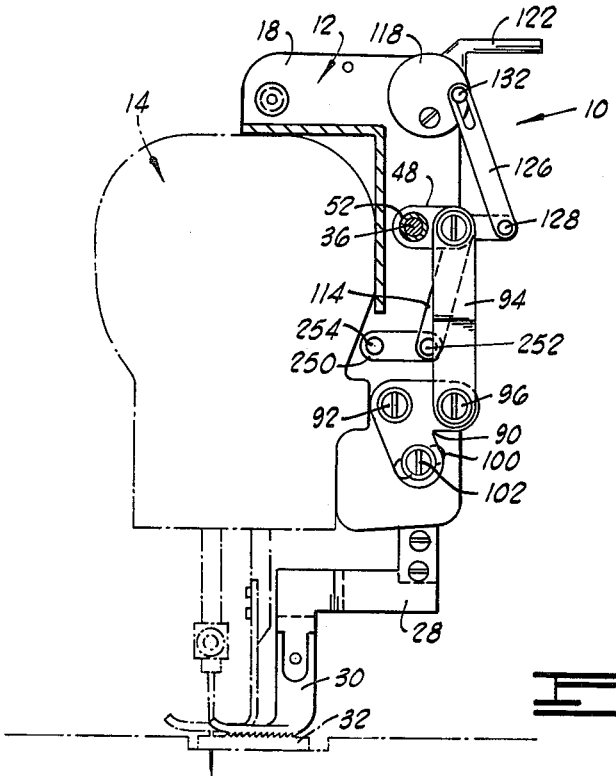
FIG. 10 is a sectional view similar to FIG. 3 but illustrating yet another alternate arrangement of apparatus of the present invention.
Figure 11:
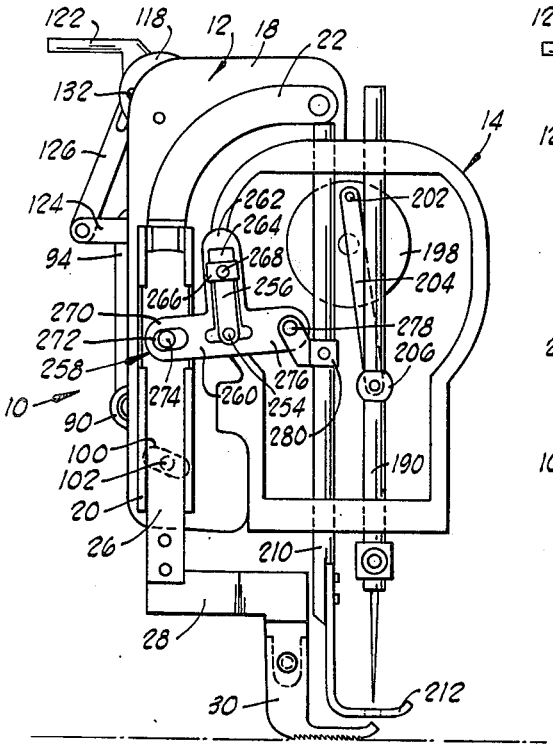
FIG. 11 is a front elevational view of a domestic sewing machine having the alternate arrangement of apparatus of FIG. 10 attached thereto.
Figure 12:
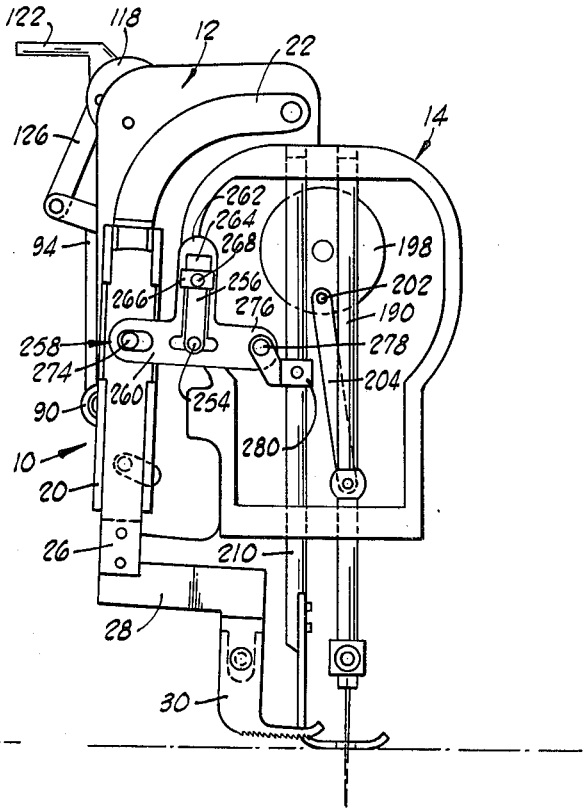
FIG. 12 is a front elevational view similar to FIG. 11 but showing the sewing machine in a different mode of operation.

Referring now to FIGS. 10, 11 and 12, yet another alternate arrangement of apparatus of the present invention is illustrated. In this embodiment, the slot 106 in the flat plate 18 and the pivotal connection between the pin 112 attached to the link 114 and the feed foot bar 26 are eliminated. Instead of imparting only vertical oscillating motion to the feed foot bar 26, the vertical oscillating motion imparted to the link 114 by way of the rod 36 is utilized to impart vertical oscillating movement to both the feed foot bar 26 and the presser foot bar 210.

Referring specifically to FIG. 10, the link 114 is pivotally connected to the outwardly extending end of an arm member 250 by a pin or bolt 252. The inner end of the arm member 250 is rigidly connected to a shaft 254 which extends through a bore (not shown) disposed in the flat plate 18 of the frame 12. Thus, the vertical oscillating motion of the link 114 is transferred by way of the arm member 250 to the shaft 254 thereby imparting oscillating rotary motion to shaft 254.

Referring now specifically to FIGS. 11 and 12, the shaft 254 extending through the flat plate 18 of the frame 12 is rigidly connected to a vertically positioned arm 256 at the lower end thereof. The upper end of the arm 256 is pivotally connected to a rocker arm assembly generally designated by the numeral 258, opposite ends of which are pivotally connected to the feed foot bar 26 and presser bar 210. The assembly 258 is comprised of an inverted T-shaped rocker arm member 260. The vertical leg 262 of the member 260 includes an elongated slot 264 disposed therein. The shaft 254 extends through the lower end of the slot 264 and a slot follower 266 is disposed in the upper portion of the slot 264. The slot follower 266 can take a variety of forms, but is generally rectangular in shape and includes grooves in the sides thereof (not shown) which engage the member 260 so that the slot follower 266 is free to move vertically without moving the member 260, but when moved horizontally the member 260 is also moved horizontally. The top end of the arm 256 is pivotally connected to the slot follower 266 by a pin 268. The horizontally disposed outwardly extending ends of the rocker arm member 260 are pivotally connected to the feed foot bar 26 and the presser foot bar 210. That is, the end 270 of the member 260 includes a slot 272 disposed therein through which a pin 274 extends. The pin 274 is rigidly attached to the feed foot bar 26. The other end 276 of the member 260 is pivotally connected by a pin 278 to a conventional connecting member 280 rigidly attached to the presser bar 210. Thus, the vertical oscillating motion of the link 114 is transmitted to the arm 256 by means of the arm member 250 and shaft 254 which in turn transmits rocking motion to the rocker arm assembly 258. The rocking motion of the assembly 258 imparts vertical oscillating motion to the feed foot bar 26 by way of the end 270 of the member 260 and opposite vertical oscillating motion to the presser bar 210 by way of the end 276 of the member 260.

OPERATION

The frame 12 of the apparatus 10 is attached to a side of the sewing machine 14 such as by a plurality of bolts or screws 41 as shown in FIG. 1. The feed rod 66 of the apparatus is connected to the feed fork of the sewing machine in a convenient manner so that the vertical oscillating motion of the feed fork and feed shaft is transmitted to the feed rod 66. As shown in FIG. 7, a presently preferred technique for operably connecting the feed rod 66 to the feed fork 146 of the sewing machine 14 is to pivotally connect the end 150 of the feed rod 66 to the arm member 142 which is also pivotally attached to the feed fork 146. This is accomplished by replacing the pin connecting the lower end 144 of the feed fork 146 to the arm 142 with a longer pin so that the lower end 150 of the feed rod 66 is pivotally connected to the arm member 142 on the opposite side of the feed fork 146.

The lift rod 70 of the apparatus of the present invention is attached to the sewing machine mechanism so that vertical oscillating motion is imparted to the lift rod 70 which is in time with but in reverse direction to the oscillating motion of the sewing machine lift fork and lifting shaft. As shown in FIGS. 6 and 7 a presently preferred technique for accomplishing this is to install a rocker arm 174 on the sewing machine 14 which is imparted vertical oscillating motion in time with the vertical oscillating motion of the feed fork 158 by the fork cam 164 attached to the lifting shaft 166. That is, the end 178 of the rocker arm 174 is positioned to follow the movement of the fork cam 164, and the lift rod 70 is pivotally connected to the other end 180 of the rocker arm 174. As the fork cam 164 and lifting shaft 166 rotate downwardly, the rocker arm 174 moves the lift rod 70 upwardly and vice versa. Thus, the lift rod 70 is imparted vertical oscillating motion in time with the motion of the lifting shaft 166 but in reverse direction thereto.

In the embodiment of this invention illustrated in FIGS. 4 and 5, the tube member 216 is installed with the bracket 222 rigidly attached to the presser bar 210 and the springs 226 and 228 are installed thereon. In operation of the apparatus, as the needle bar 190 is moved downwardly, the presser foot 212 is also moved downwardly into contact with workpiece being stitched so that the workpiece is held in a stable position. As the needle bar 190 is moved upwardly, the presser bar 210 and presser foot 212 are also moved upwardly in the manner previously described. During the upward movement of the needle bar 190, the feed dog 32 of the sewing machine 14 is raised by conventional mechanism operably connected to the lifting shaft 166 and then moved in the direction of feed by conventional mechanism operably connected to the feed shaft 140. Simultaneously, with the movement of the feed dog, the presser foot 30 is moved downwardly by the movement of the lift rod 70, the rod 36, the link 114, the pin 112 and feed foot bar 26. Following the downward movement, the feed foot 30 is moved in the direction of feed by the movement of the feed rod 66, the tube 52, the link 94, the bell crank 90 and the tubular member 20. During the downward movement of the needle bar 90, the feed dog 32 of the sewing machine 14 is lowered and returned in the opposite direction to its original location. Simultaneously, the feed foot 30 is raised and returned in the opposite direction to the location it occupied at the beginning of the cycle. Thus, in operation of the apparatus of the present invention, as the needle bar 190 and presser foot 212 are moved to the upper position as shown in FIG. 5, the feed foot 30 moves in time with the feed dog 32 so that the workpiece being stitched is gripped on its bottom surface by the feed dog 32 and on its top surface by the feed foot 30 and advanced in the direction of feed. After the workpiece has been advanced, the presser foot 212 is lowered into contact with the workpiece so that the workpiece is held in a flat stable position while the needle 196 penetrates the workpiece. As the needle bar 190 and presser foot 212 are moved to the lower position as shown in FIG. 4, the feed foot 30 moves in time with the feed dog 32 back to the forward position preparatory to again advancing the workpiece.

As will be understood, the manual lifting mechanism of the apparatus 10 is utilized to lift the feed foot 30 when the workpiece to be stitched is installed in or removed from the feed mechanism. More specifically, the rotation of the disk 118 by means of the handle 122 raises the arm member 50 which is attached by means of the link 114 and pin 112 to the feed foot bar 26 thereby raising the feed foot bar 26 and the feed foot 30 attached thereto.

In operation of the alternate embodiment of the invention shown in FIGS. 8 and 9, the feed foot 30 is moved in the direction of feed and returned in the opposite direction in time with the movement of the feed dog 32 in the same manner as described above. That is, the movement of the feed rod 66 is transmitted to the bell crank 90 and pin 102 connected to the tubular member 20 so that the tubular member 20, feed foot bar 26, and feed foot 30 are moved in horizontal directions in time with the horizontal movement of the feed dog 32. The vertical movement of the feed foot 30 is imparted to the feed foot bar 26 by the cam follower member 234 which also imparts the vertical movement to the presser bar 210. That is, as the needle bar 190 is moved downwardly by the rotation of the disk 198 and the corresponding downward movement of the link 204 attached thereto, the cam pin 230 fixedly attached to the disk 198 moves the cam follower member 234 downwardly. This, in turn, moves the presser bar 210 and presser foot 212 downwardly until the presser foot 212 contacts the workpiece being stitched as shown in FIG. 9. Upon contact with the workpiece, the downward movement of the presser bar 210 is stopped which causes the arm of the cam follower 230 pivotally connected to the feed foot bar 26 by the pin 238 to move upwardly thereby moving the feed foot 30 upwardly. As the needle bar 190 is moved upwardly the reverse of the foregoing action takes place, i.e. the presser bar 210 and the presser foot 212 are moved upwardly out of contact with the workpiece and the presser foot 30 is moved downwardly into contact with the workpiece as shown in FIG. 8.

As will be understood, the cam pin 230 is positioned and the cam follower 234 is of a configuration such that when the needle bar 190 is moved upwardly or downwardly, the presser foot 212 is moved in a corresponding manner and the upward and downward movement of the feed foot 30 is in timed relation to the downward and upward movement of the feed dog of the sewing machine. Since the feed foot 30 and presser foot 212 are both moved in response to rotation of the shaft attached to the disk 198, the sewing machine power shaft can be rotated manually in the usual manner to cause the disk 198 to rotate to a position where both the feed foot 30 and presser foot 212 are in a raised position. This allows the installation and removal of a workpiece without the need of a separate feed foot lift mechanism.

In operation of the alternate embodiment of the invention shown in FIGS. 10 through 12, the feed foot 30 is moved in the direction of feed and returned in the opposite direction in time with the movement of the feeding dog 32 in the same manner as described above. The vertical movement of the feed foot 30 is imparted to the feed foot bar 26 by the rocker arm assembly 258 which also imparts opposite vertical movement to the presser bar 210. That is, the vertical oscillating movement of the link 114 is transferred to the arm 256 by the arm member 250 and shaft 254 so that the upper end of the arm 256 pivotally attached to the slot follower 266 moves back and forth in substantially horizontal directions. The slot follower 266 is operably connected within the slot 264 of the member 260 so that the member 260 is given a rocking motion and pivots around the shaft 254 extending through the bottom portion of the slot 264 disposed therein. The ends 270 and 276 of the member 260 are oscillated vertically in opposite directions, which movement is transmitted to the feed foot bar 26 and presser bar 210. Thus, as the feed foot bar 26 and feed foot 30 attached thereto are moved downwardly, the presser bar 210 and presser foot 212 attached thereto are moved upwardly and vice-versa.

As will be understood, the movement of the rocker arm assembly 258 is timed with the movement of the needle bar 190 such that when the needle bar 190 is moved upwardly or downwardly, the presser foot 212 is moved in a corresponding manner, and the upward and downward movement of the feed foot 30 is in timed relation to the downward and upward movement of the feed dog of the sewing machine 14.

Thus, the attachment apparatus of the present invention for converting a domestic sewing machine having a bottom feed mechanism to one having a top and bottom workpiece gripping feed mechanism is well adapted to carry out the objects and advantages mentioned as well as those inherent therein. As will be understood by those skilled in the art, the particular means employed for connecting the feed rod 66 and lift rod 70 to the mechanism of the sewing machine whereby the feed rod 66 is imparted vertical oscillating motion, corresponding with the vertical oscillating motion of the sewing machine feed shaft, and the lift rod 70 is imparted vertical oscillating motion in time with but reverse to the vertical oscillating motion of the sewing machine lifting shaft will vary somewhat depending upon the particular domestic sewing machine to which the apparatus of the present invention is attached. The construction and arrangement of parts for causing the presser bar and presser foot to follow the motion of the needle bar can also take a variety of forms which will suggest themselves to those skilled in the art. The present invention, therefore, is not to be limited to the presently preferred construction and arrangement of parts described herein for purposes of this disclosure, but is to be limited only by the lawful scope of the claims appended hereto.

What is claimed is:

1. Apparatus for attachment to a sewing machine having a bottom workpiece feed mechanism comprised of a feed dog positioned in the work supporting surface of said machine which is raised and lowered by the oscillating motion of a lifting shaft and moved in the direction of feed and returned in the opposite direction by the oscillating motion of a feed shaft, a vertically oscillated needle bar, and a presser foot attached to a presser bar for urging the workpiece being stitched against said work supporting surface and said feed dog, said apparatus converting said sewing machine to one having a top and bottom workpiece gripping feed mechanism whereby workpieces of extra thickness can be fed through said mechanism and stitched by said machine, the apparatus comprising:

a frame adapted to be attached to a side of said sewing machine;

a vertically positioned tubular member pivotally attached to said frame so that said member is free to move horizontally but not vertically;

a feed foot bar telescopically mounted within the lower end of said tubular member so that said feed foot bar is free to move vertically and is moved horizontally with the movement of said tubular member;

a feed foot attached to said feed foot bar and positioned above said sewing machine work supporting surface adjacent said feed dog;

bell crank means for converting vertical oscillating motion to horizontal oscillating motion pivotally attached to said frame and to said tubular member so that horizontal oscillating motion is imparted to said tubular member;

feed rod means adapted to be operably connected to said feed shaft of said sewing machine so that vertical oscillating motion corresponding to the oscillating motion of said shaft is imparted to said feed rod means;

means for transmitting the vertical oscillating motion of said feed rod means to said bell crank means attached to said frame and connected between said feed rod means and said bell crank means so that when said feed dog is moved in the direction of feed and returned by the oscillating motion of said feed shaft, said tubular member is moved horizontally in a like manner;

link means attached to said feed foot bar for imparting vertical oscillating motion thereto;

lift rod means adapted to be operably connected to said lifting shaft of said sewing machine so that vertical oscillating motion corresponding with the oscillating motion of said shaft but in reverse directions is imparted to said lift rod means;

means for transmitting the vertical oscillating motion of said lift rod means to said link means attached to said frame and connected between said lift rod means and said link means so that when said feed dog is raised and lowered by the oscillating motion of said lifting shaft, said feed foot bar and feed foot attached thereto are simultaneously lowered and raised respectively.

2. The apparatus of claim 1 which is further characterized to include means for manually raising said feed foot bar and said feed foot attached to said frame and to said link means.

3. The apparatus of claim 2 which is further characterized to include means adapted to be attached to said sewing machine for raising said presser bar and presser foot attached thereto when said feed foot is lowered and while said feed dog and said feed foot are moved in the direction of feed so that said workpiece is readily fed through said feed mechanism.

4. The apparatus of claim 3 wherein said means for raising said presser foot when said feed foot is lowered and while said feed dog and said feed foot are moved in the direction of feed comprises:

a tube member having an annular flange formed at the lower end thereof adapted to be telescopically positioned over the top end of said presser bar and rigidly attached to said needle bar so that said tube member is simultaneously oscillated with said needle bar;

a sleeve adapted to be rigidly attached to said presser bar providing upwardly and downwardly facing annular surfaces thereon;

first spring means adapted to be disposed around said presser bar between said annular flange at the lower end of said tube member and the upwardly facing surface of said sleeve;

second spring means adapted to be disposed around said presser bar between the downwardly facing surface of said sleeve and an upwardly facing surface of said sewing machine;

said first spring means being of greater resiliency than said second spring means so that when said tube member is lowered by said needle bar, said first spring means is compressed which in turn compresses said second spring means and lowers said presser bar and presser foot attached thereto, and when said tube member is raised by said needle bar, said first spring means is expanded which in turn allows the expansion of said second spring means and the raising of said presser bar and presser foot thereby.

* * * * *